US007587870B2

(12) United States Patent
Voegele, Jr. et al.

(10) Patent No.: US 7,587,870 B2
(45) Date of Patent: Sep. 15, 2009

(54) GRID SYSTEM FOR MOUNTING BUILDING BLOCKS

(75) Inventors: William P. Voegele, Jr., Pittsburgh, PA (US); Raymond A. McNally, Blawnox, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 129 days.

(21) Appl. No.: 11/676,377

(22) Filed: Feb. 19, 2007

(65) Prior Publication Data

US 2007/0193154 A1 Aug. 23, 2007

Related U.S. Application Data

(60) Provisional application No. 60/775,166, filed on Feb. 21, 2006.

(51) Int. Cl.

| | |
|---|---|
| ***E04B 5/46*** | (2006.01) |
| ***E04B 2/00*** | (2006.01) |
| ***E04B 2/14*** | (2006.01) |
| ***E06B 3/00*** | (2006.01) |

(52) U.S. Cl. ..... 52/308; 52/306; 52/307; 52/456; 52/475.1

(58) Field of Classification Search ..... 52/306, 52/307, 308, 601, 456, 475.1, 665, 655.1, 52/656.9

See application file for complete search history.

(56) References Cited

U.S. PATENT DOCUMENTS

| | | | | | |
|---|---|---|---|---|---|
| 2,052,229 | A | | 8/1936 | Hyde | |
| 2,314,238 | A | * | 3/1943 | Ohlis | 52/466 |
| 2,655,881 | A | * | 10/1953 | Lenke | 52/467 |
| 3,234,699 | A | | 2/1966 | Smith | |
| 3,778,175 | A | * | 12/1973 | Zimmer | 403/187 |
| 3,844,087 | A | | 10/1974 | Schultz et al. | |
| 4,058,943 | A | | 11/1977 | Sturgill | |
| 4,114,337 | A | | 9/1978 | Neuhardt | |
| 4,251,964 | A | | 2/1981 | Francis | |
| 4,455,798 | A | | 6/1984 | Tsakiris | |
| 4,458,464 | A | * | 7/1984 | Borghetto | 52/477 |
| 4,610,901 | A | | 9/1986 | Linscott | |
| 4,638,613 | A | | 1/1987 | Tonsmann | |
| 4,774,793 | A | | 10/1988 | Mayer | |
| 4,959,937 | A | * | 10/1990 | Mayer | 52/308 |
| 4,965,975 | A | | 10/1990 | Schwarz | |
| 4,974,385 | A | * | 12/1990 | McFadden et al. | 52/200 |
| 4,986,048 | A | | 1/1991 | McMarlin | |
| 4,999,964 | A | | 3/1991 | Taylor | |

(Continued)

*Primary Examiner*—Brian E Glessner
*Assistant Examiner*—Jason Holloway
(74) *Attorney, Agent, or Firm*—McKay & Associates, P.C.

(57) ABSTRACT

A block assembly that includes first framing members, second framing members, and clips, wherein each of the clips is inserted through a respective one of the first framing members. Each of the clips has an upper portion that extends above an upper surface of the first framing member through which it is inserted and a lower portion that extends below a lower surface of the first framing member through which it is inserted. For each of the clips, the upper portion is received within a first one of the second framing members and the lower portion is received within a second one of the second framing members such that the first and second framing members form a grid including openings. The block assembly further includes a plurality of blocks, with each of the blocks being received within a respective one of the openings.

11 Claims, 4 Drawing Sheets

U.S. PATENT DOCUMENTS 5,003,744 A 4/1991 Taylor
5,010,704 A 4/1991 Thompson
5,031,372 A 7/1991 McCluer
5,042,210 A 8/1991 Taylor
5,119,567 A * 6/1992 Fox ..... 33/526
5,146,725 A * 9/1992 Bruce et al. ..... 52/308
D331,469 S 12/1992 McMarlin
5,218,806 A 6/1993 Taylor
5,259,161 A 11/1993 Carter
5,356,675 A 10/1994 Unger et al.
5,430,985 A 7/1995 Coleman
5,448,864 A * 9/1995 Rosamond ..... 52/307
5,485,702 A 1/1996 Sholton
5,640,819 A * 6/1997 Wirkus et al. ..... 52/308
5,655,345 A * 8/1997 Thompson ..... 52/396.1
5,704,177 A 1/1998 Wirkus et al.
5,715,636 A 2/1998 Taylor
5,740,646 A 4/1998 Wirkus et al.
5,806,263 A * 9/1998 Coleman ..... 52/306
5,845,443 A * 12/1998 Wirkus et al. ..... 52/308
5,904,018 A * 5/1999 Campagnari ..... 52/306
5,907,937 A * 6/1999 Loftus et al. ..... 52/308
6,223,489 B1 * 5/2001 Fisher ..... 52/308
6,226,952 B1 * 5/2001 Romeu Guardia ..... 52/698
6,922,961 B2 8/2005 Wright
7,090,226 B1 * 8/2006 Trainor et al. ..... 277/630
7,124,546 B2 * 10/2006 Scharff et al. ..... 52/314
2003/0208975 A1 * 11/2003 Regina ..... 52/306
2004/0177577 A1 9/2004 Voegele, Jr. et al.
2007/0039261 A1 * 2/2007 Girardi ..... 52/306
2007/0130859 A1 * 6/2007 Borressen et al. ..... 52/306
2008/0134605 A1 * 6/2008 Friesen et al. ..... 52/308

* cited by examiner

GRID SYSTEM FOR MOUNTING BUILDING BLOCKS

CROSS-REFERENCE TO RELATED APPLICATION

This application claims the benefit of provisional application Ser. No. 60/775,166, entitled "A Grid System for Mounting Building Blocks," which was filed on Feb. 21, 2006, the disclosure of which is incorporated herein by reference.

FIELD OF THE INVENTION

The present invention relates to grid systems for building walls or other structures utilizing building blocks, most commonly glass blocks.

BACKGROUND OF THE INVENTION

Grid systems designed to hold building blocks in a spaced relationship are well known. Most commonly, these are intended as an alternative to laying the blocks (typically glass or masonry) in mortar. The existing grid systems tend to use components of thin dimensions and of relatively weak construction. Furthermore, the existing systems have relatively weak connections between the horizontal and vertical framing members and, in some cases, no connections at all. In addition, existing systems typically depend on a sealant material, such as silicone or urethane, to seal the blocks against water infiltration at their perimeters.

Furthermore, most existing grid systems which are intended for use with glass blocks incorporate portions of the linear framing members which engage the center ridges which exist around the perimeters of the edges of common glass blocks. This feature helps to stabilize the blocks but prevents the use of those particular blocks that do not have the perimeter recesses and ridge features common to most glass blocks. Also, many of the existing grid systems do not include cavities that are continuous in either the longitudinal or transverse directions in such a way that they can act as a conduit for strip lighting, wiring, liquid carrying hoses, or other such elements.

Still further, existing grid systems typically rely on using the block elements to act as gauges to determine the spacing between the (short) vertical framing members. This can result in a grid system which is not precisely aligned owing to variations in the sizes of the blocks or foreign objects that may be lodged between the blocks and the framing members. Existing systems typically rely on a sealant material, such as silicone or urethane, as the exposed joint material and as the means of preventing water from entering the wall system. The use of such sealant materials does not typically provide a consistent appearance and typically requires periodic replacement due to wear caused by age or weathering.

Should water pass through the outer portions of the joints, existing grid systems do not have a provision for directing the leakage water to the bottom of the wall and then exhausting same to a desired location. Existing grid systems are also not built with the option for accepting rectilinear blocks which have flat, square edges and alternatively, common glass blocks which have recessed ridges around their perimeter edges. Finally, existing grid systems do not typically include a provision for the entire system to expand and contract at the sides and tops of a given wall opening. This can be a major factor, in particular in the case of framing members that are made of thermoplastics or other materials that have a high thermal expansion coefficient and in the case where large walls are constructed. Thus, there is a need for a block mounting system that addresses one or more of the above-described problems associated with existing grid systems.

SUMMARY OF THE INVENTION

The present invention, in one or more embodiments, provides an assembly of horizontal and vertical framing members which, when assembled, creates a grid. The grid forms discrete openings into which building blocks are placed as the grid is assembled. During the assembly process, clips are fitted through holes in the horizontal framing members. Lower portions of the clips engage vertical framing members beneath and upper portions of the clips engage vertical framing members above. The outside edges of the vertical and horizontal framing members are exposed to view and offer many optional colors and joint treatments. In addition, provision is made for accepting thermal expansion and contraction of the framing members. Optionally, elements can be housed within the horizontal framing members to provide increased strength or other features such as conduits for lighting, power, or fluid. The entire system can be assembled very quickly by relatively unskilled personnel.

In one embodiment, the present invention provides a block assembly that includes a plurality of first framing members, a plurality of second framing members, and a plurality of clips, wherein each of the clips is inserted through a respective one of the first framing members. In addition, each of the clips has an upper portion that extends above an upper surface of the first framing member through which it is inserted and a lower portion that extends below a lower surface of the first framing member through which it is inserted. For each of the clips, the upper portion is received within a first one of the second framing members and the lower portion is received within a second one of the second framing members such that the clips interconnect the first and second framing members to form a grid including a plurality of openings. The block assembly further includes a plurality of blocks, such as glass, plastic or masonry blocks, with each of the blocks being received within a respective one of the openings.

The lower portion of each of the clips may include a plurality of legs which are inserted through holes provided in the first framing members. Also, for each of the clips, the upper portion may be received within a cavity provided within a first one of the second framing members and the lower portion may received within a cavity provided within a second one of the second framing members.

In addition, for each of the blocks, a sealant may be provided between the block and the first framing members between which the block is located. Alternatively, for each of the blocks, one or more elastomeric members may be provided between the block and the first framing members between which the block is located.

In one particular embodiment, each of the first framing members may also include a central cavity, wherein a reinforcing element is received within the central cavity. Alternatively, one or more of a hose, a wire or a lighting element may be provided within the central cavity of one or more of the first framing members. In another particular embodiment, each of first framing members includes a first outer flange and a second outer flange opposite the first outer flange, and an elastomeric strip is attached to each of the first outer flanges and each of the second outer flanges. Finally, the block assembly may further includes an angle clip for moveably attaching the block assembly to a wall, wherein a first portion of the angle clip is affixed to the wall and wherein a second portion of the angle clip is slideably received within a cavity provided within one of the first framing members.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
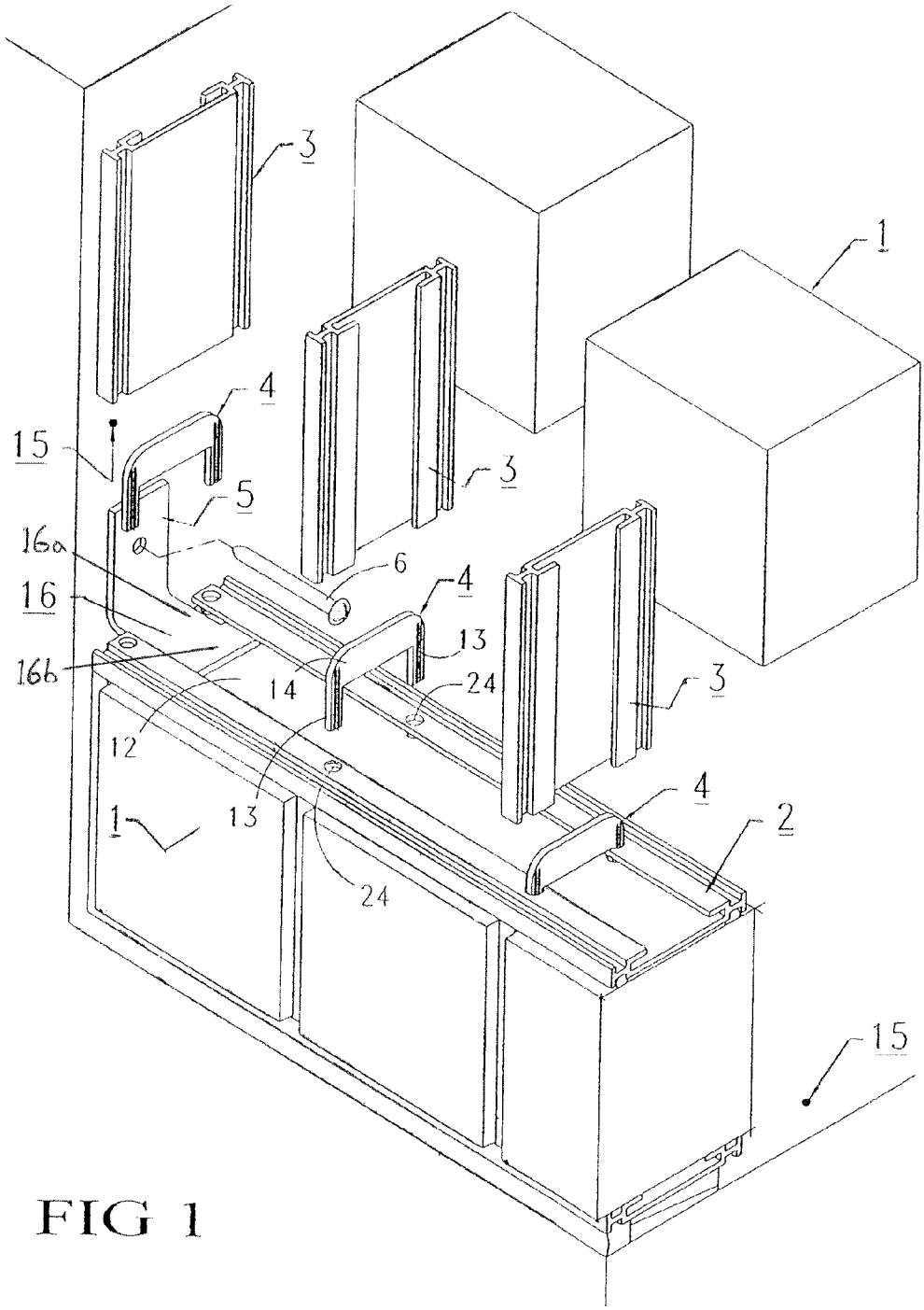
FIG. 1 is an exploded view of a block assembly according to an embodiment of the present invention.

FIG. 1 is an exploded view of an array of blocks 1, which are typically made of masonry, plastic, or glass (although other suitable materials may also be used) and which are assembled within a grid framework composed of horizontal framing members 2 and vertical framing members 3, all of which are held together by horseshoe clips 4. Framing members 2 and 3 and clips 4 are typically made of aluminum or of plastics such as PVC or FRP, although other suitable materials may also be used. The described array of blocks 1 and grid framing formed by the framing members 2 and 3 typically forms a wall, which then typically fills a substrate opening 15. The horizontal framing members 2 are secured to the jamb surfaces of the substrate 15 via angle clips 5, the clips being secured to the jamb wall via anchors 6, which may be screws, nails, or masonry anchors, among other suitable fasteners. The horizontal portion 16 of each clip 5 is slidably engaged in the cavity 12 of the associated horizontal framing member 2 so as to allow for expansion and contraction of the horizontal framing member 2. The vertical framing members 3 are secured to the horizontal framing members 2 via the horseshoe clips 4. As can be seen in FIG. 1, the horizontal portion 16, or second portion, is generally T-shaped such that its outer end 16*b* has a width greater than its inner end 16*a*. In this manner, inner end 16*a* is of a width which allows each clip 4 to penetrate aligned holes 24 defined on each first framing member while the angle clip 5 is simultaneously maintained within the cavity 12. As seen in FIG. 1, the downward extending legs 13 of the clips 4 pass through holes 24 that are provided in the horizontal framing members 2 and then pass into the channel openings 12 of the underlying vertical framing member 3. Another (overlying) vertical framing member 3 then slides over the upper surface 14 of the clip 4 thus connecting the vertical framing member 3 to the horizontal framing member 2. The holes are preferably precisely spaced so as to consistently determine the distance between vertical framing members 3. As the grid system is built, the building blocks 1 are progressively inserted into the discrete openings that are created by the grid system.

Figure 2:
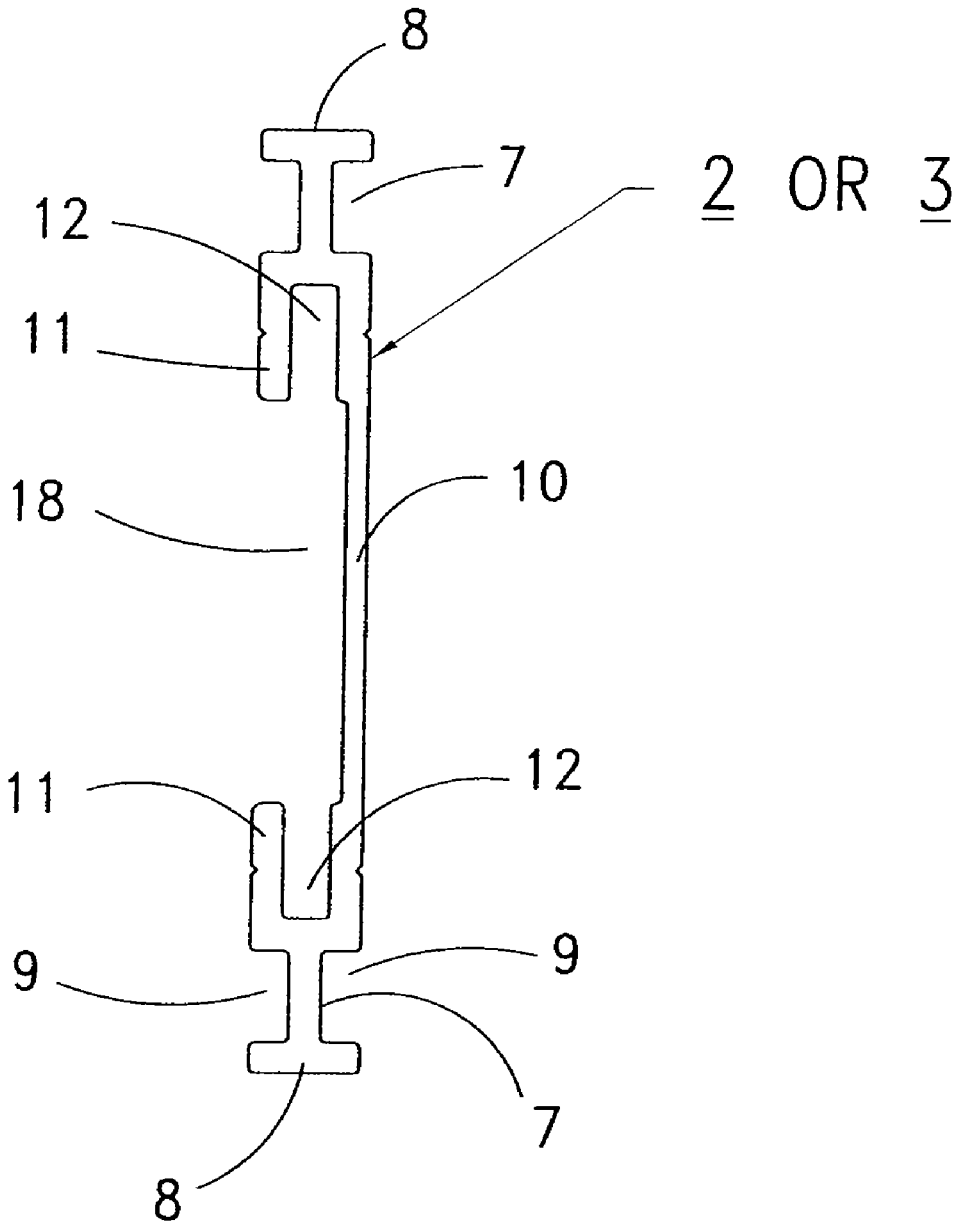
FIG. 2 is a cross-section through a horizontal framing member or a vertical framing member employed in the assembly of FIG. 1.

FIG. 2 is a cross-section through a horizontal framing member 2 or a vertical framing member 3. These members are composed of two outer flanges 8, which are connected to central web portions 7 which, in turn, are connected to an elongated channel portion composed of a web 10 and flange portions 11 which, when spaced apart from web 10, create cavities 12 at each end of the channel.

Figure 3:
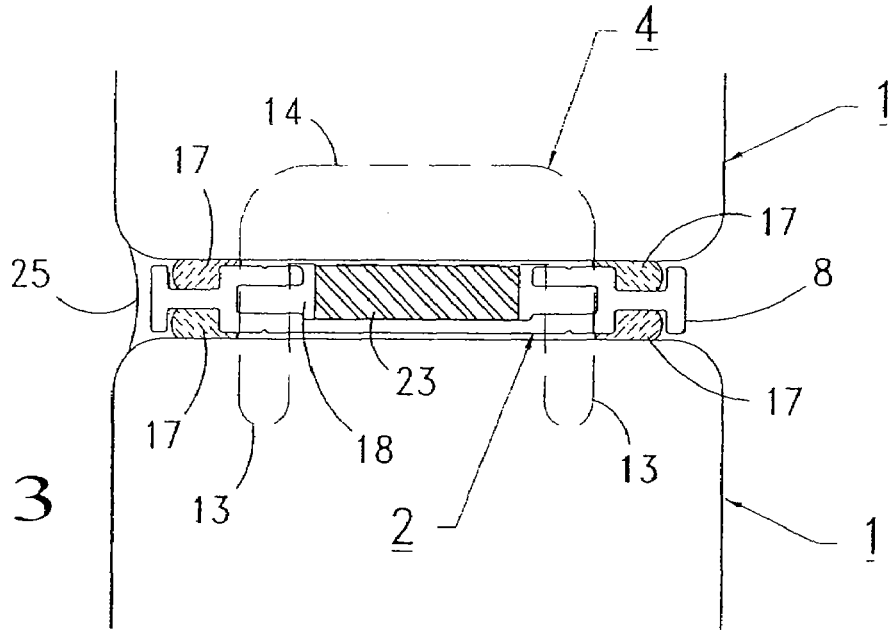
FIG. 3 is a side sectional view which illustrates a typical horizontal framing member which is positioned between two building blocks.

FIG. 3 illustrates a typical horizontal framing member 2, which is positioned between two building blocks 1. Shown with dotted lines is a typical clip 4, which passes through the holes 24 provided in the horizontal framing member 2 and which includes downwardly extending legs 13 and an upwardly extending body portion 14.

A sealant/adhesive 17 is shown in one preferred embodiment as a means of sealing the joints between the horizontal framing members 2 and the building blocks 1 as well as being a means for adhering and permanently joining the horizontal framing members 2 and the building blocks 1. In a preferred embodiment, a sealant 25 may be installed as an exterior joint seal. In one particular embodiment, a steel reinforcement member 23 is provided within the cavity 18 of the horizontal framing member 2 as a means for adding strength to the horizontal framing member 2.

Figure 3A:
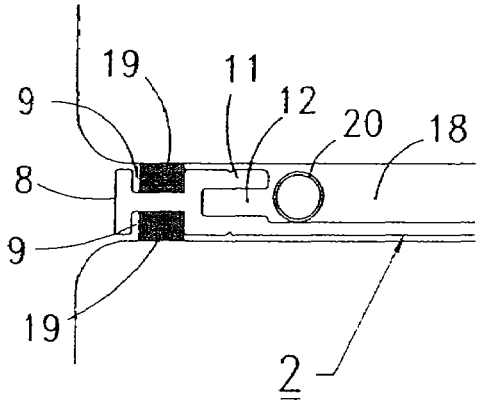
FIG. 3A is a side sectional view a portion of a horizontal framing member or a vertical framing member employed in the assembly of FIG. 1 that includes optional elastomeric sealing cushions according to one particular embodiment of the invention.

FIG. 3A illustrates a portion of the horizontal framing member 2 (and the vertical framing member 3) and includes optional elastomeric sealing cushions 19 engaged in the cavities 9 of the horizontal framing members 2 (or the vertical framing members 3 as the case may be). These elastomeric sealing cushions 19 may be composed of elastomeric materials such as EPDM or neoprene and serve to seal the joints between the building blocks 1 and the framing members 2 or 3. Also illustrated is a hose, wiring or lighting element 20 which, as an option, may be placed within the cavities 18 of the horizontal framing members 2 in order to convey electrical power, liquids, and/or lighting elements.

Figure 3B:
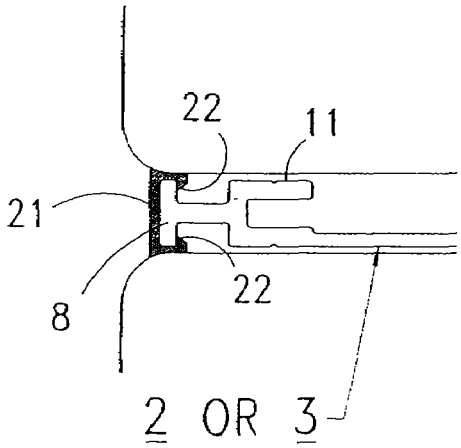
FIG. 3B is a side sectional view a portion of a horizontal framing member or a vertical framing member employed in the assembly of FIG. 1 wherein the outer flanges thereof are covered by continuous elastomeric strips according to another particular embodiment of the invention.

FIG. 3B shows another preferred embodiment wherein the outer flanges 8 of the horizontal framing members 2 and/or the vertical framing members 3 are covered by continuous elastomeric strips 21. Preferably, the strips 21 are formed as channels with barbs 22 which cause the elastomeric strips 21 to be secured to the flanges 8. Being an elastomeric material, such as EPDM or neoprene, the strips 21 provide sealing of the joints between the building blocks 1 and the framing members 2 and 3 and also provide support where building blocks 1 rest upon them.

Figure 4:
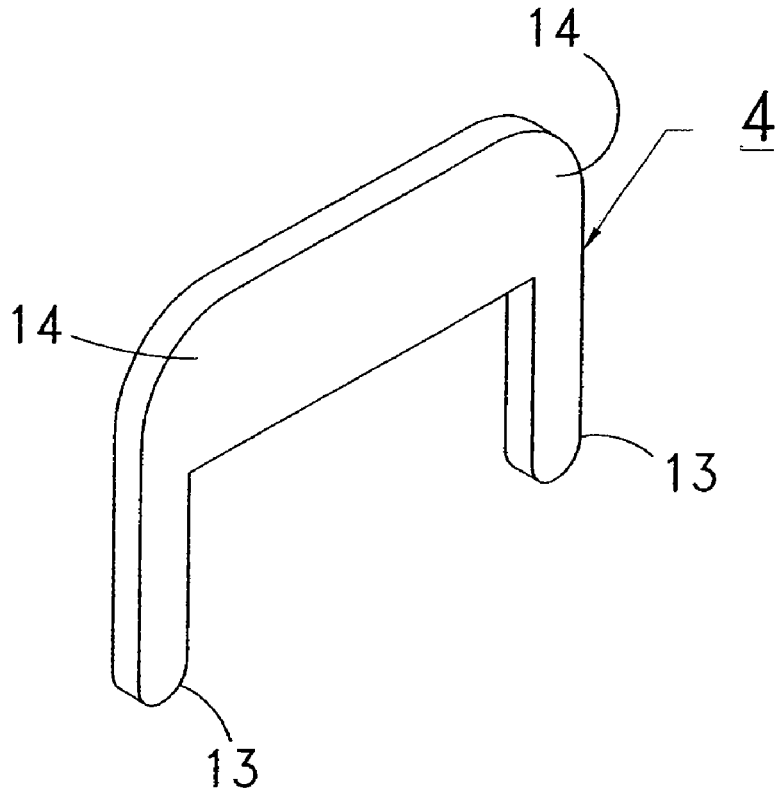
FIG. 4 is an isometric view of a typical horseshoe clip employed in the assembly of FIG. 1.

FIG. 4 is an isometric drawing of a typical horseshoe clip 4, which has been previously described. The clips 4 may be made of thermoplastic, FRP aluminum, steel, or any other suitable material. The downward legs 13 are of a dimension which allows the legs 13 to fit through the holes 24 provided in the horizontal framing members 2 as illustrated in FIG. 1. As can be seen, legs 13 are co-planar to upper body portion 14. The holes 24 are nominally a quarter inch in diameter and the downward legs 13 of the clip 4 are sized to allow for an appropriate clearance, typically on the order of 0.010 inches. Also, the downward legs 13 have a thickness that is designed to fit inside cavity 12 of the vertical framing members 3 with an appropriate clearance, typically on the order of 0.010 inches. The horseshoe clip 4 also has an upper body portion 14, the thickness of which is designed to fit into the cavities 12 of the vertical framing members 3 with an appropriate clearance, typically on the order of 0.010 inches. The engagement of the legs 13 and the upper body portions 14 of the clips 4 as just described secure the vertical framing members 3 to the horizontal framing members 2.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A block assembly, comprising:

at least one block;

a plurality of first framing members having holes defined therein;

a plurality of second framing members each having a cavity defined therein;

one or more angle clips having a first portion and a second portion for moveably attaching said block assembly to a wall, said first portion oriented vertically and affixed to said wall said second portion oriented horizontally and slidably received within said cavity of said first framing member; and, a plurality of horseshoe clips, wherein each of said horseshoe clips has two legs making up its lower portion inserted through a respective one of said first framing members and at least one of said horseshoe clips is disposed over said second portion of said angle clip through said holes of said first framing member, and wherein each of said clips has an upper portion aligned axially with said legs that extends above an upper surface of the first framing member through which it is inserted;

wherein upon assembly said legs of at least one of said horseshoe clips retain said second portion of said angle clip in place while said upper portion of said horseshoe clips enters said cavity of said second framing member and interconnects said first and second framing members to form a grid including a plurality of openings.

2. The block assembly according to claim 1, wherein said blocks are glass blocks.

3. The block assembly according to claim 1, wherein said blocks are plastic blocks.

4. The block assembly according to claim 1, wherein said blocks are masonry blocks.

5. The block assembly according to claim 1, wherein for each of said blocks, a sealant is provided between the block and the first framing members between which the block is located.

6. The block assembly according to claim 1, wherein for each of said blocks, a sealant is provided between the block and the second framing members between which the block is located.

7. The block assembly according to claim 1, wherein for each of said blocks, one or more elastomeric members are provided between the block and the first framing members between which the block is located.

8. The block assembly according to claim 1, wherein for each of said blocks, one or more elastomeric members are provided between the block and the second framing members between which the block is located.

9. The block assembly according to claim 1, wherein each of first framing members includes a first outer flange and a second outer flange opposite said first outer flange, and wherein an elastomeric strip is attached to each of said first outer flanges and each of said second outer flanges.

10. The block assembly according to claim 1, wherein said first framing members are oriented in a horizontal manner and said second framing members are oriented in a vertical manner.

11. The block assembly according to claim 1, wherein one or more of a hose, a wire or a lighting element are provided within said cavity.

* * * * *